US011993928B2

(12) United States Patent
Marshall

(10) Patent No.: US 11,993,928 B2
(45) Date of Patent: May 28, 2024

(54) HYBRID WALL SYSTEM

(71) Applicant: Falkbuilt Ltd., Calgary (CA)

(72) Inventor: Dale R. Marshall, Foothills (CA)

(73) Assignee: Falkbuilt Ltd., Calgary (CA)

( * ) Notice: Subject to any disclaimer, the term of this patent is extended or adjusted under 35 U.S.C. 154(b) by 132 days.

(21) Appl. No.: 17/720,838

(22) Filed: Apr. 14, 2022

(65) Prior Publication Data

US 2023/0009544 A1 Jan. 12, 2023

Related U.S. Application Data

(60) Provisional application No. 63/220,889, filed on Jul. 12, 2021.

(51) Int. Cl.
*E04B 2/82* (2006.01)
*E04B 1/38* (2006.01)
*E04B 2/58* (2006.01)

(52) U.S. Cl.
CPC ..... *E04B 2/58* (2013.01); *E04B 1/388* (2023.08)

(58) Field of Classification Search
CPC ..... E04B 2/58; E04B 1/388
See application file for complete search history.

(56) References Cited

U.S. PATENT DOCUMENTS 1,234,903 A * 7/1917 Jester ..... E04B 2/58 52/285.3
1,277,397 A * 9/1918 Edwards, Jr. ..... E04B 2/58 52/285.3
1,506,442 A * 8/1924 O'Hara ..... E04B 2/58 52/762
1,630,801 A * 5/1927 Parsons ..... E04B 2/58 249/193
1,779,713 A * 10/1930 Satterlee ..... E04B 2/845 52/274
1,858,715 A * 5/1932 Mckay ..... E04B 9/22 52/363

(Continued)

FOREIGN PATENT DOCUMENTS

WO 2012039678 3/2012
WO 2017069698 4/2017

OTHER PUBLICATIONS

Murray, Tara; "Solid Wall Patent Background"; Haworth; Mar. 13, 2020; 7 pages.

(Continued)

*Primary Examiner* — Basil S Katcheves
(74) *Attorney, Agent, or Firm* — Steven L. Nichols; Fabian VanCott

(57) ABSTRACT

A hybrid wall system includes studs with spacers interspersed between the studs. The spacer is a flat elongate member with at least one hook-like member on each end of the elongate member to secure ends of the elongate member between two studs. At least one snap member on each end of the elongate member is removed to remove the spacer to release the spacer between the two studs. The system further includes a base track and a top track with a slip spacer assembly used to level the tops of the studs. A drop-in ceiling is placed on top of the leveled studs. A leveling assembly on the base track is used to raise and lower at least one of the studs for purposes of attaching cladding to the at least one stud.

20 Claims, 20 Drawing Sheets

(56) References Cited

U.S. PATENT DOCUMENTS 1,876,756 A * 9/1932 Robinson ..... E04B 2/58 52/353
3,482,369 A * 12/1969 Burke ..... E04B 2/763 52/669
3,778,952 A * 12/1973 Soucy ..... E04B 2/763 52/696
4,193,233 A 3/1980 Vandenhoek
5,274,973 A * 1/1994 Liang ..... E04B 2/58 52/317
5,377,466 A 1/1995 Insalaco
5,542,219 A * 8/1996 Dias ..... E04B 2/7427 248/188.4
5,606,836 A 3/1997 Insalaco
5,666,774 A * 9/1997 Commins ..... E04H 12/2253 248/188.4
5,685,662 A 11/1997 Rollin
5,720,138 A * 2/1998 Johnson ..... E04B 2/7457 52/656.1
5,839,240 A 11/1998 Elsholz
5,884,448 A * 3/1999 Pellock ..... E04B 7/022 52/696
6,109,461 A 8/2000 Kluge
6,112,485 A 9/2000 Beyer
6,209,268 B1 * 4/2001 Schmidt ..... E04B 1/2608 52/93.2
6,213,679 B1 4/2001 Frobosilo
6,253,529 B1 * 7/2001 De Boer ..... E04B 2/7457 52/36.5
6,260,318 B1 * 7/2001 Herren ..... E04B 2/7453 52/696
6,349,516 B1 2/2002 Powell
6,367,205 B2 * 4/2002 Cornett, Sr. ..... E04B 7/02 52/223.13
6,481,177 B1 11/2002 Wood
6,694,695 B2 * 2/2004 Collins ..... E04B 2/7457 52/656.1
6,701,689 B2 * 3/2004 diGirolamo ..... E04B 2/763 52/243
6,705,056 B2 * 3/2004 Tollenaar ..... E04B 2/7457 52/696
6,711,871 B2 3/2004 Beirise
6,739,562 B2 * 5/2004 Rice ..... E04B 2/7457 403/194
6,843,035 B1 * 1/2005 Glynn ..... E04B 2/7457 52/573.1
6,889,477 B1 * 5/2005 Kottman ..... E04B 2/7422 52/64
6,920,831 B2 * 7/2005 Lin ..... A47B 57/408 211/187
7,216,465 B2 * 5/2007 Saldana ..... E04C 3/11 52/715
D607,711 S * 1/2010 Adams ..... D8/354
7,694,483 B1 4/2010 Tucker
7,707,795 B2 * 5/2010 Yu ..... E04B 2/7422 403/402
8,011,160 B2 * 9/2011 Rice ..... E04B 2/763 52/712
8,015,767 B2 9/2011 Glick
8,205,402 B1 * 6/2012 diGirolamo ..... E04B 2/765 52/669
8,387,321 B2 * 3/2013 diGirolamo ..... E04B 2/58 52/713
8,615,959 B2 * 12/2013 Ferguson ..... E04B 2/767 52/653.1
D702,533 S * 4/2014 Noturno ..... E04G 21/1891 D8/354
8,695,310 B2 4/2014 Tremblay
8,733,044 B2 * 5/2014 Dollerup ..... E04B 2/765 52/290
9,103,108 B2 * 8/2015 Lin ..... E04C 3/30
9,523,196 B2 * 12/2016 Rice ..... E04B 2/762
9,677,297 B2 * 6/2017 Warner ..... E02D 27/42
9,963,869 B1 5/2018 Mironchuk
10,041,288 B1 8/2018 Flood
10,214,902 B1 * 2/2019 Wheeler ..... E04C 3/07
10,323,412 B2 6/2019 Koziol
10,364,566 B1 * 7/2019 LeBlang ..... E04B 2/7453
11,008,753 B2 * 5/2021 Daudet ..... E04B 2/763
11,142,901 B2 10/2021 Friedlos
2001/0039774 A1 11/2001 Beirise
2002/0020137 A1 * 2/2002 Commins ..... E04B 1/2604 52/712
2002/0062617 A1 5/2002 Digirolamo
2002/0157335 A1 * 10/2002 Vos ..... E04B 2/821 52/239
2003/0106280 A1 * 6/2003 diGirolamo ..... E04B 2/7457 52/656.1
2004/0031224 A1 * 2/2004 Elderson ..... E04B 2/7457 52/481.1
2005/0247654 A1 11/2005 Walker
2006/0053714 A1 * 3/2006 Pryor ..... E04H 12/2253 52/292
2006/0054765 A1 * 3/2006 Griengl ..... E04H 12/2261 248/346.01
2006/0236625 A1 10/2006 Macdonald
2008/0104922 A1 * 5/2008 Glick ..... E04B 2/7425 52/630
2009/0013639 A1 * 1/2009 Tremblay ..... E04B 5/02 52/745.13
2009/0193735 A1 8/2009 Kalinowski
2010/0006518 A1 1/2010 Brobst
2013/0091691 A1 4/2013 Oetlinger
2014/0331564 A1 11/2014 Wei
2016/0069072 A1 3/2016 Rice
2016/0168863 A1 6/2016 Kwan
2017/0204600 A1 7/2017 Daudet
2018/0094422 A1 4/2018 Getz
2018/0094431 A1 * 4/2018 Koziol ..... E04F 13/081
2019/0112829 A1 * 4/2019 Manos ..... E04B 1/2604
2019/0203494 A1 * 7/2019 West ..... E04B 1/388
2019/0249418 A1 8/2019 Chapman
2019/0285224 A1 * 9/2019 McKechnie ..... F16M 11/18
2019/0380492 A1 12/2019 Heap
2020/0318339 A1 * 10/2020 Friedlos ..... E04B 2/7437
2021/0079648 A1 3/2021 Viebahn
2021/0180315 A1 6/2021 Marshall

OTHER PUBLICATIONS

Author unknown; Teknion Leveler Foot Image; 1 page; Retrieved from online search in Apr. 2019.
Slotted Standard Hooks Image; Retrieved from internet search Jun. 2019; 1 page.
Racking Images; Retrieved from internet search Apr. 2019; 1 page.
https://www.bmp-group.com/; viewed website on Feb. 3, 2022; 3 pages.
https://www.clarkdietrich.com/; viewed website on Feb. 3, 2022; 3 pages.

* cited by examiner

HYBRID WALL SYSTEM

BACKGROUND

Digitized wall systems provide innovative solutions over drywall installation by providing manufactured wall components to be used for quick and efficient onsite installation.

DETAILED DESCRIPTION

Figure 1:
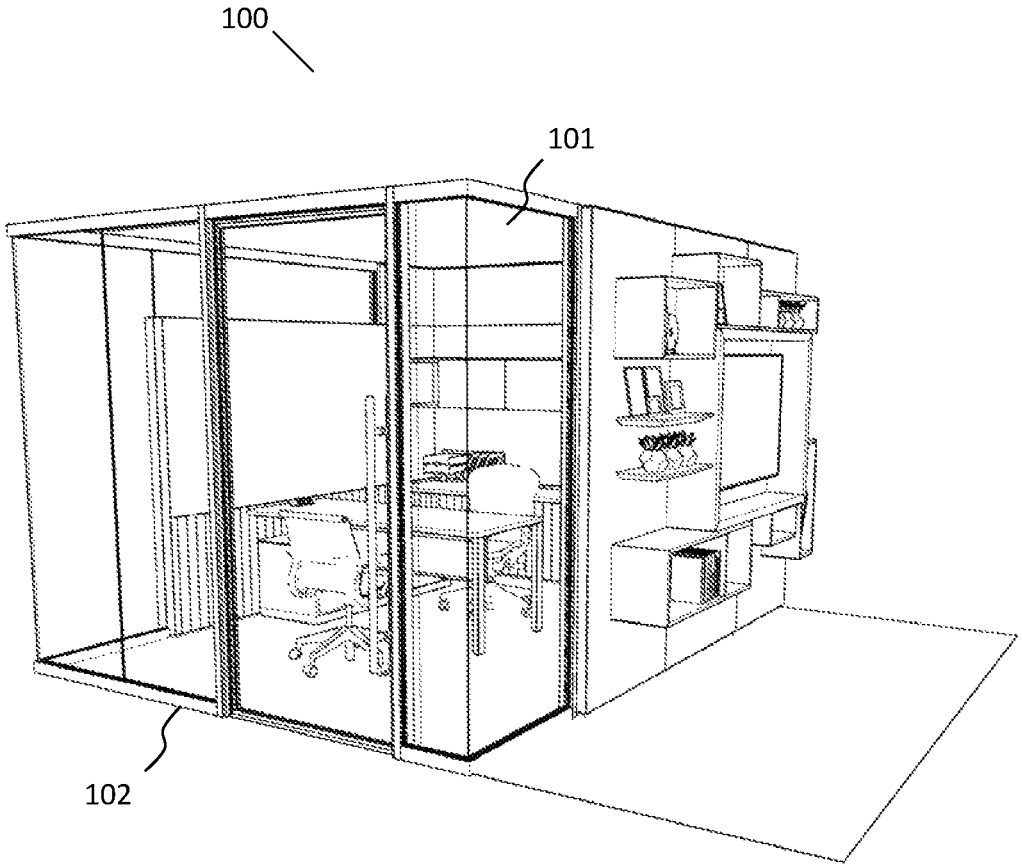
FIG. 1 illustrates a perspective view of a wall system according to an example of the principles described herein.

Construction projects may involve the purchase and delivery to a job site of 30% more materials than what is needed for the project. These projects rely on materials and tools such as drywall, drywall mud and tape, steel studs, screw guns, hammers, nails. Laborers fill garbage bins with waste created from the construction. When the project is completed, the bin is hauled to a dump.

In another example, referred to as a modular construction, the construction of the project is accomplished in a factory, the project loaded in trucks, and then taken to a jobsite. After the walls or room modules of the project are unloaded from the trucks, the modules are placed side-by-side in designated locations and orientations. Each module is then individually leveled with respect to a ground surface and attached to adjacent modules.

The present specification describes digital component construction methods that combine aesthetics with high-performing and cost-effective solutions. Under these methods, individual components are precisely manufactured and then delivered and installed. There is no need for clean up or waste removal and the cost remains competitive with other types of construction.

As part of construction, a wall system is assembled using the various components and methodology that will be described herein. Particularly, a hybrid wall system incorporates components and methodology that enable a wall space to be used with cladding, drywall, or a combination thereof.

In an example, a spacer for a hybrid wall system includes a flat elongate member. At least one hook-like member is located on each end of the elongate member to secure ends of the elongate member between two studs. At least one snap member is located on each end of the elongate member. The snap member is to be removed when it is desired to remove the spacer from between two studs. The removal of the at least one snap member prevents progression and thus allows continual use of the two studs without the spacer. "Progression" as used herein refers to the steady incline toward permanency in a structure as each component is added. The growing structural permanence of the hybrid wall system wherein components may not be modified or removed is thus prevented with the incorporation of a snap member.

In another example, a hybrid wall system includes studs with spacers interspersed between the studs. The studs are attached to a base track. A top track is attached on top of the studs. A leveling assembly on a first portion of the base track is used to raise and lower at least one of the studs for purposes of attaching cladding to the at least one stud. In this example, no leveling assembly is used on a second portion of the base track for purposes of attaching drywall to remaining studs.

In another example, a hybrid wall system includes studs with spacers interspersed between the studs. The studs are attached to a base track. A top track is attached on top of the studs. A slip spacer assembly is used to level the tops of the studs. Once leveled, a drop-in ceiling is placed on top of the studs. A slip connection of the slip spacer assembly enables an accommodation for differential floor deflection between a ceiling on the top track and a floor beneath the base track.

With the hybrid wall system, walls may be easily joined together so as to create defined spaces such as living spaces within multi-family and residential housing structures, or work spaces within corporate buildings. Turning to FIG. 1, a hybrid wall system 100 is shown for an office space 101. The office space 101 is defined by walls 102 that may be digitally created. With a hybrid wall system 100, cladding or drywall may be used to define the office space 101. Additional walls may be attached to the walls 102 of the office space 101 to create additional offices.

To enable wall spaces to be used with cladding, drywall, or a combination thereof, removable spacers are used in between studs. The spacers allow cladding to be hung and are designed to break off so that they do not become a permanent feature when attached between studs. With spacers removed, drywall can then be attached to the studs. Thus, components may be modified or removed with the incorporation of a snap member.

Figure 2:
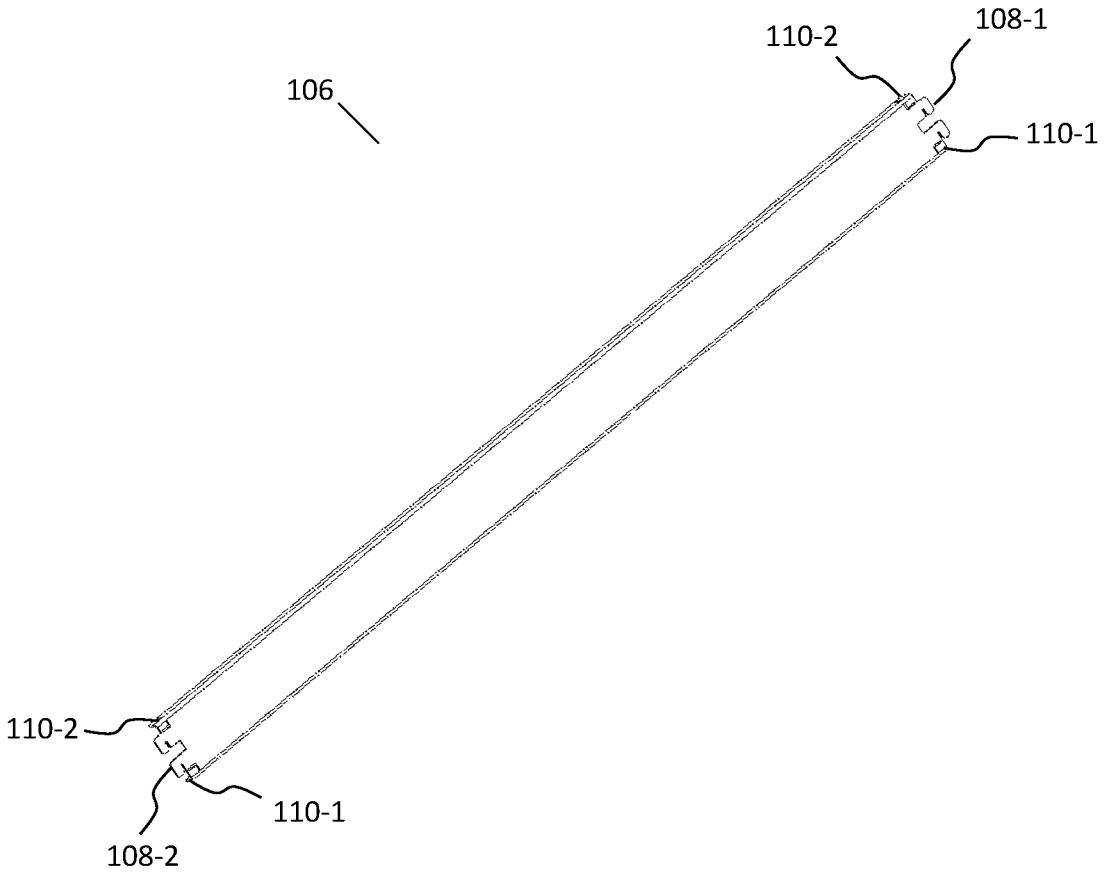
FIG. 2 illustrates a front view of a spacer of a wall system according to an example of the principles described herein.

Turning to FIG. 2, a spacer 106 is shown according to principles described herein. The spacer 106 is a flat elongate member with two elongate sidewalls that extend perpendicularly away from the elongate member. The elongate member further includes at least one hook-like member at either end. The hook-like members are used to attach the spacer 106 to corresponding studs on either side of the spacer 106. Also included with the spacer 106 are snap members 110-1, -2 on either end of the elongate member. Each snap member 110-1, -2 is to be removed from the attached elongate member to prevent progression or permanent attachment of structural members and thus allow continual use of the two studs without the spacer 106.

Figure 3:
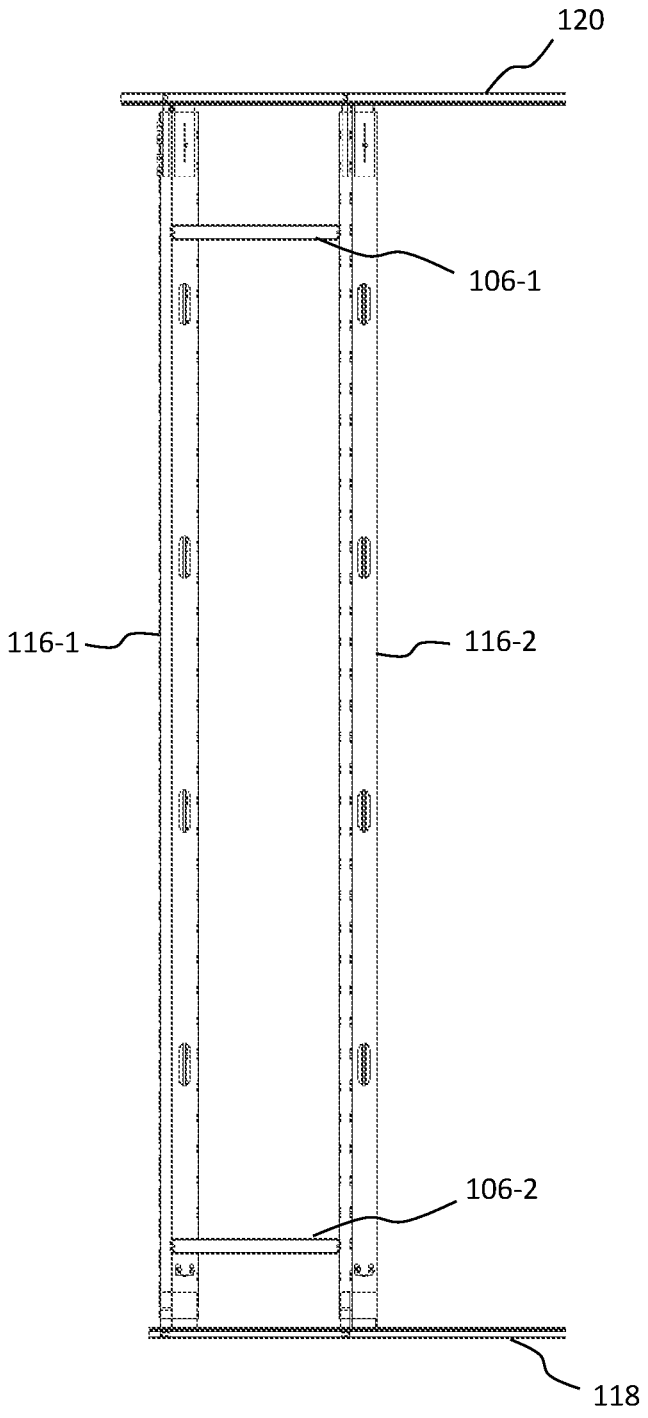
FIG. 3 illustrates a front view of two spacers used between two studs according to an example of the principles described herein.

Turning to FIG. 3, a stud configuration with spacers 106-1, -2 is shown. The stud configuration includes two studs 116-1, -2 that are separated by spacers 106-1, -2. Spacer 106-1 is located a distance below the top of the studs while spacer 106-2 is located a distance above the bottom of the studs 116-1, -2. The spacers 106-1, -2 may be located along the height of the pair of studs 116-1, -2 as desired. The number of spacers between studs may be one, two, or more. Also shown in FIG. 3 is a base track 118 and a top track 120. The studs are attached at bottom ends to the base track 118 and at top ends to the top track 120.

Figure 4:
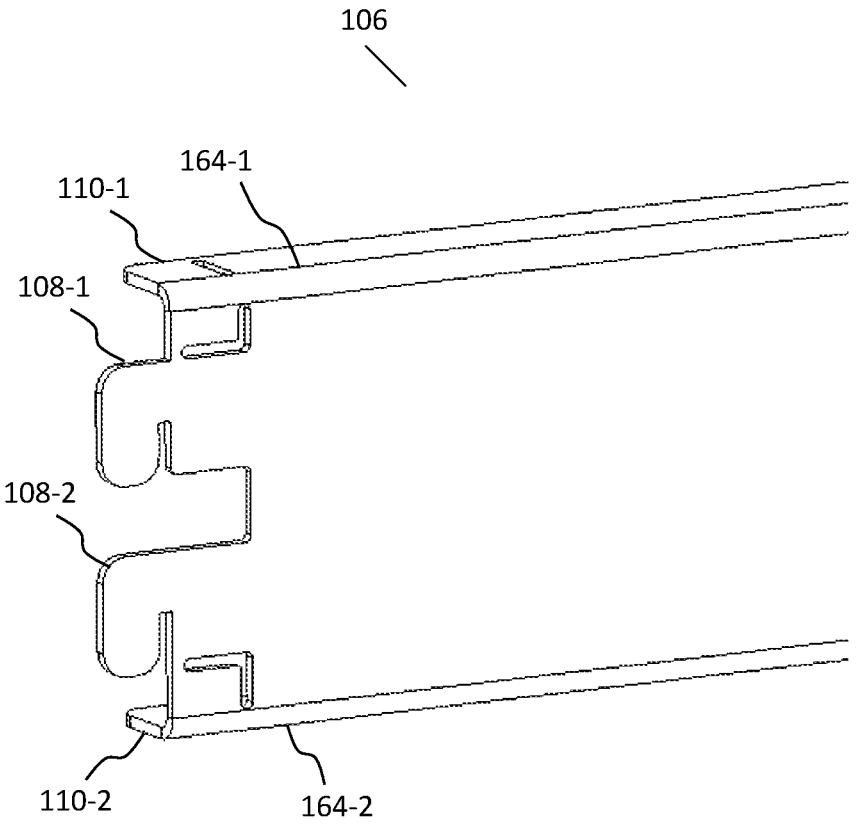
FIG. 4 illustrates a perspective view of an end portion of a spacer according to an example of the principles described herein.

Turning to FIG. 4, a close-up view of an end portion of the spacer 106 is shown. Two hook-like members 108-1, -2 are centrally located at the end portion. They extend outward along a longitudinal axis of the elongate member. The hook-like members 108-1, -2 bend at a 90 degree angle to form a hook. Each hook-like member 108-1, -2 is received in a corresponding hole of a stud to attach the spacer 106 to the corresponding stud.

Also on the spacer 106 are two snap members 110-1, -2 at each end corner. The snap members 110-1, -2 are located at corners of the elongate member and ends of the sidewalls. In an example, each snap member 110-1, -2 is a single unit that adjoins the corners of the elongate member and ends of the sidewalls. In another example, each snap member 110-1, -2 includes two pieces that are unique and separate from each other. As shown, snap member 110-1 includes a first corner piece that extends from an end of the sidewall and a second corner piece on an end corner of the elongate member. The two corner pieces of snap member 110-1 are attached to a common rim 164-1 or edge of the elongate member that extends between the sidewall and the elongate member. Thus, the two corner pieces of snap member 110-1 may be broken off separately from the spacer 106 along the common rim 164-1. The same configuration is shown for snap member 110-2 on the opposite side of the elongate member with common rim 164-2. In the example shown, the snap members 110-1, -2 have slits or otherwise breakable material at edges that are adjacent to a respective elongate member or side edge. This configuration allows the snap members 110-1, -2 to be snapped off from the spacer 106 when desired. When the spacer 106 is attached to studs 116-1, -2 (see FIG. 3), the snap members 110-1, -2 abut sides of the studs 116-1, -2, in a tight fit. Once the snap members 110-1, -2 are broken or snapped off the spacer 106, there is a slight gap of the attachment of the spacer 106 to the studs 116-1, -2, and the attachment of the spacer 106 that would otherwise be permanent or semi-permanent, is released. The spacer 106 may be removed which allows for attachment of drywall instead of cladding.

Figure 5:
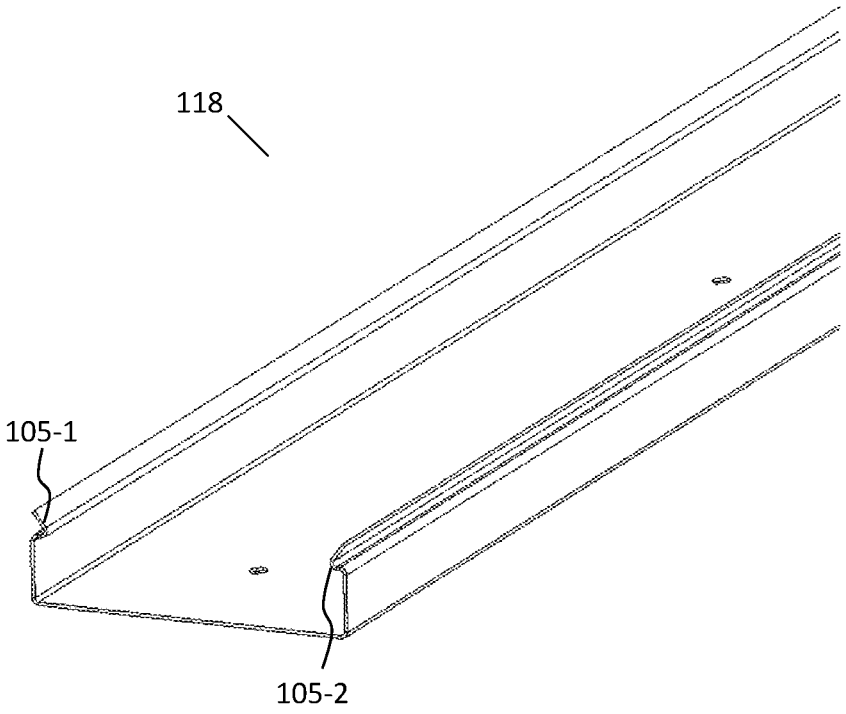
FIG. 5 illustrates a perspective view of an end portion of a base track according to an example of the principles described herein.

Turning to FIG. 5, the base track 118 is shown. The base track 118 includes a generally flat elongate base track 118 having sidewalls that extend perpendicularly from side edges of the base track 118. Each sidewall has an offset bend 105-1, -2 at an end portion such that the end portion juts toward an inner space between the sidewalls with outer edges extending at an angle relative to the sidewalls. In other words, the sidewalls bend inward and then bend at an angle so that the end portion of the sidewall angles outward. The angle may be a 45 degree angle relative to the bottom of the base track 118. Moreover, the angle may be an angle that is less than 90 degrees relative to the bottom of the base track 118.

The offset bends 105-1, -2 are to tighten around sides of a leveling assembly, discussed below, to removably lock the leveling assembly to the base track 118. The offset bend 105-1, -2 are also used to tighten around sides of a stud to removably lock the stud in place. The offset bends 105-1, -2 may include resilient properties. Thus, as sidewalls of studs are lowered onto the bottom of the base track 118, the sidewalls may yield or bend slightly and resiliently tend to move back toward a neutral position. This helps in assembly of the structure as well as maintaining a strong hold of the studs and lower assemblies.

Figure 10:
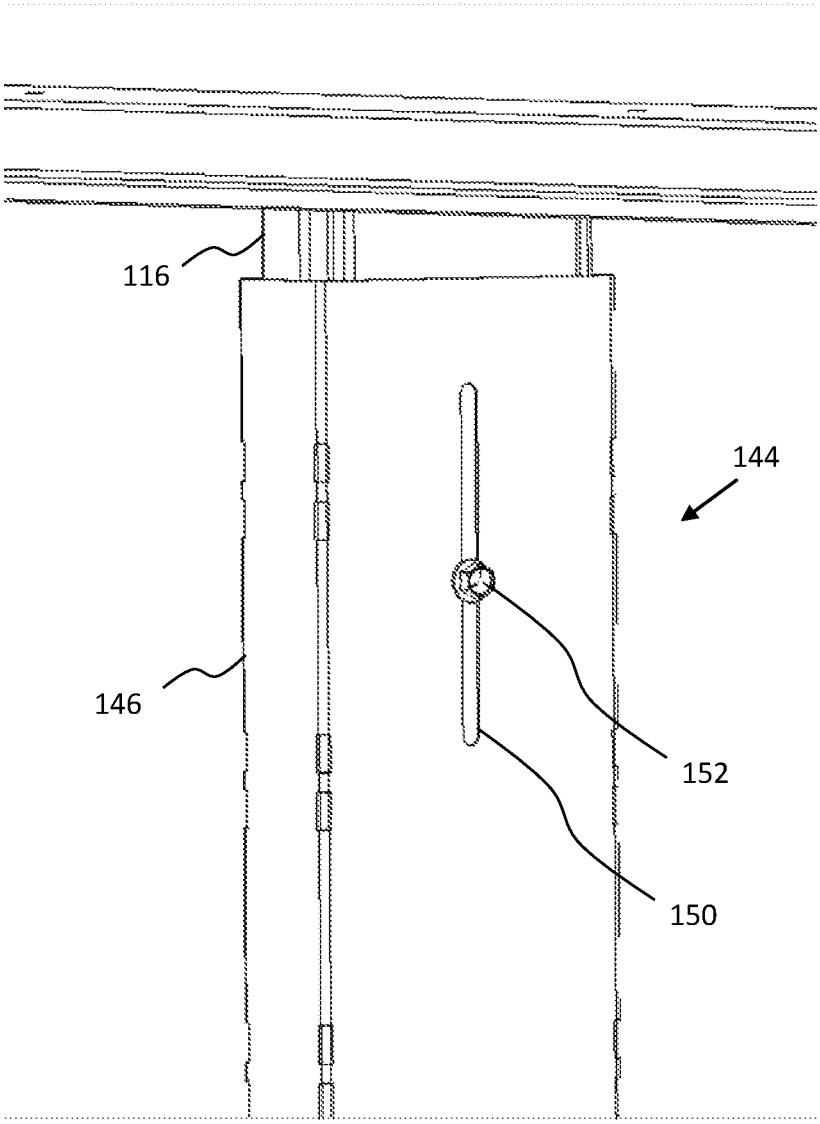
FIG. 10 illustrates a perspective view of a slip spacer assembly attached to a stud according to an example of the principles described herein.

The base track 118 may be the same as the top track 120 (see FIG. 10). For assembly, the top track is lowered on top of the stud for securement. This is in reverse manner of assembly of the bottom track to the stud, namely, instead of lowering a stud on to a track, the track is lowered on top of the stud. As explained below, the sides of the top track 120 tighten around top sides of the stud to secure the top track 120 to the stud.

Figure 6:
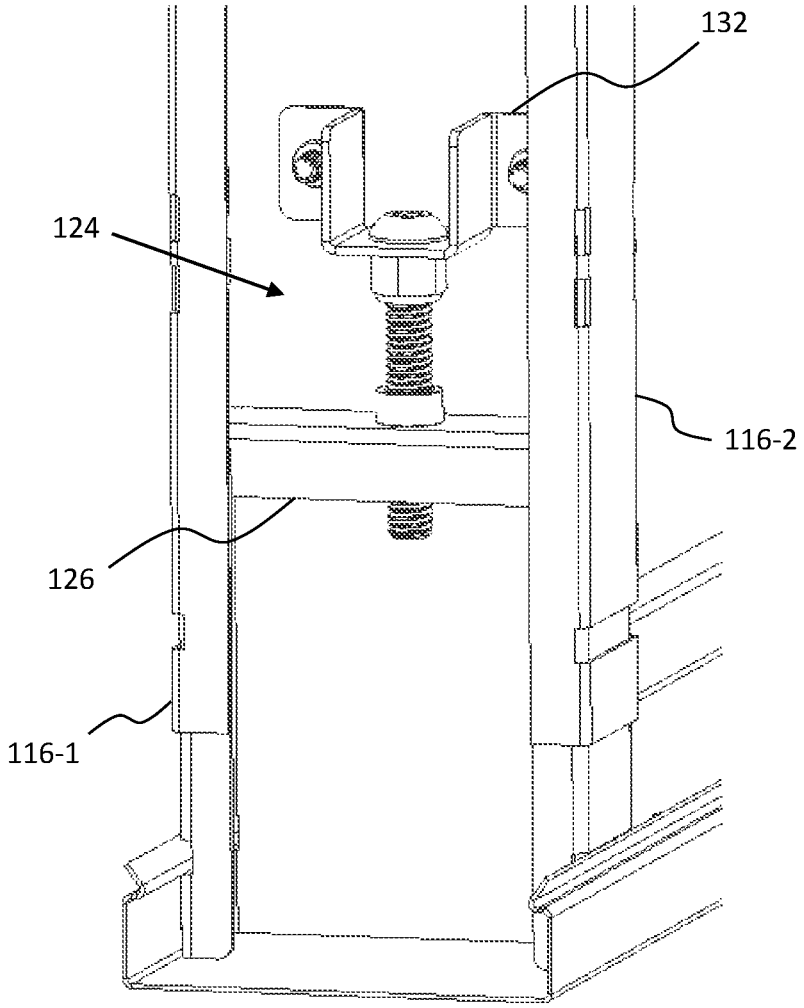
FIG. 6 illustrates a perspective view of a leveling assembly attached to a base track according to an example of the principles described herein.

Turning to FIG. 6, a leveling assembly 124 is shown. The leveling assembly 124 is attached to the base track 118 and a stud so as to lift and lower the stud relative to the base track 118 and thereby level the stud according to the rest of the studs. An appropriate stud height is achieved so that cladding may be installed and the ceiling be placed on top of the studs.

The leveling assembly 124 includes a lower leveler support 126 and an upper leveler support 132. They are connected by a screw which lifts and lowers the upper leveler support 132. The upper leveler support 132 is attached to studs 116-1, -2. The lower leveler support 126 is attached to the base track 118, which remains in place.

Figure 7:
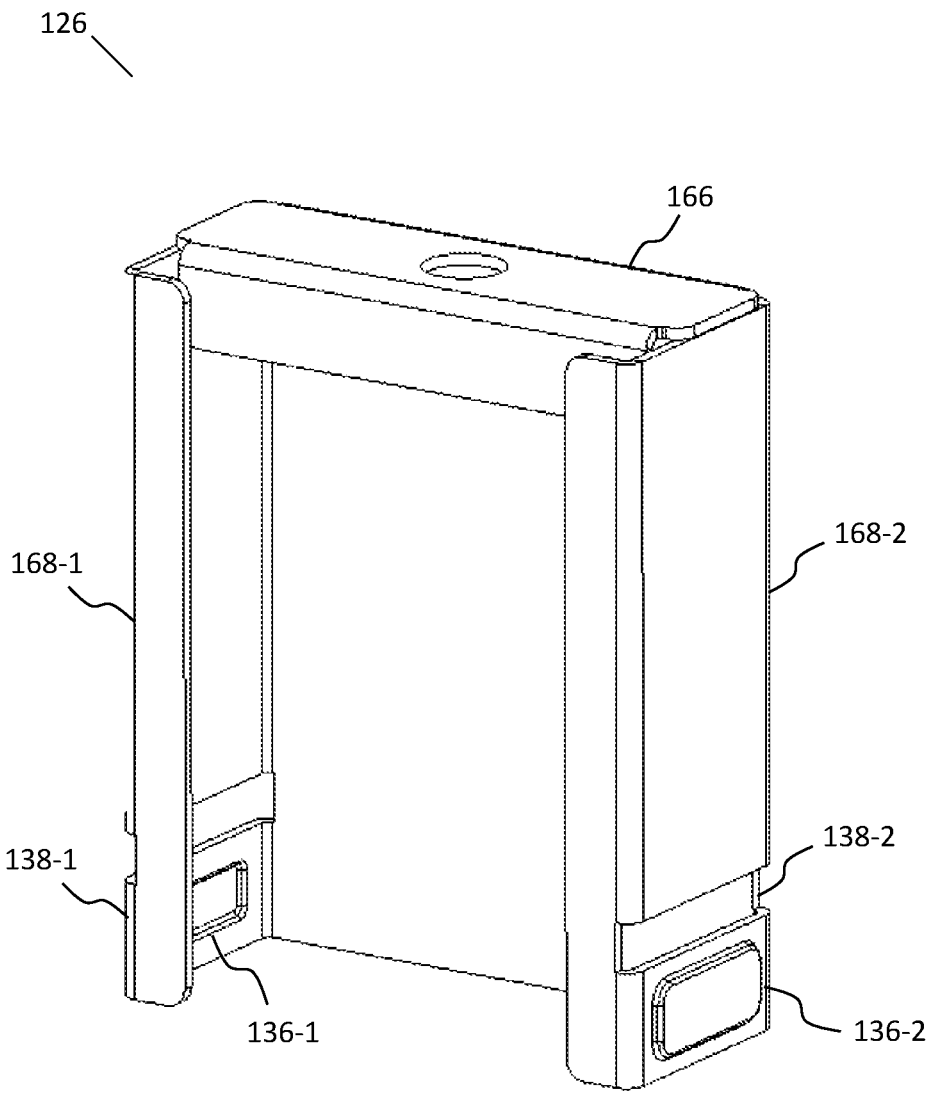
FIG. 7 illustrates a perspective view of a lower leveler support according to an example of the principles described herein.

Turning to FIG. 7, the lower leveler support 126 is shown and includes a generally flat elongate member 166. Sidewalls 168-1, -2 extend perpendicularly away from each end of the elongate member 166, each sidewall 168-1, -2 having an attachment at one end to attach to the base track 118. The sidewalls 168-1, -2 of the lower leveler support 126 each have a square or rectangular cross-sectional area to nest within sidewalls of the stud and thus provide strength to the wall assembly as a whole. At end portions of the sidewalls 168-1, -2 are outer facing button-shaped protrusions 136-1, -2 that are to lock the sidewalls of the leveling assembly 124 between sidewalls of the base track 118. Also at end portions of the sidewalls 168-1, -2 are notches 138-1, -2 to lock the stud to the base track 118.

Figure 8:
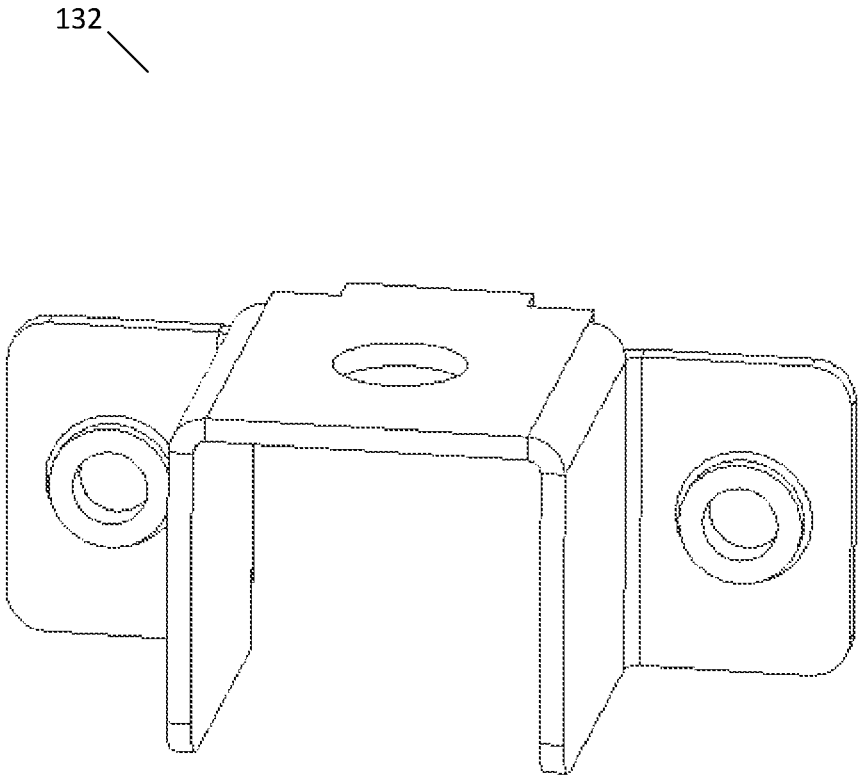
FIG. 8 illustrates a perspective view of an upper leveler support according to an example of the principles described herein.

Turning to FIG. 8, an upper leveler support 132 is shown and includes a generally flat top and perpendicular sidewalls that extend from the flat top. Side arms extend in a wing-like manner from edges of the sidewalls and in a parallel direction as the flat top. The side arms are located on either side of the flat top and perpendicular sidewalls. The side arms are to be affixed with screws to a stud. The flat top is to be affixed to the lower leveler support 126 (see FIG. 7) by a screw such that adjustment of the screw raises and lowers the stud affixed to the upper leveler support 132.

Figure 9:
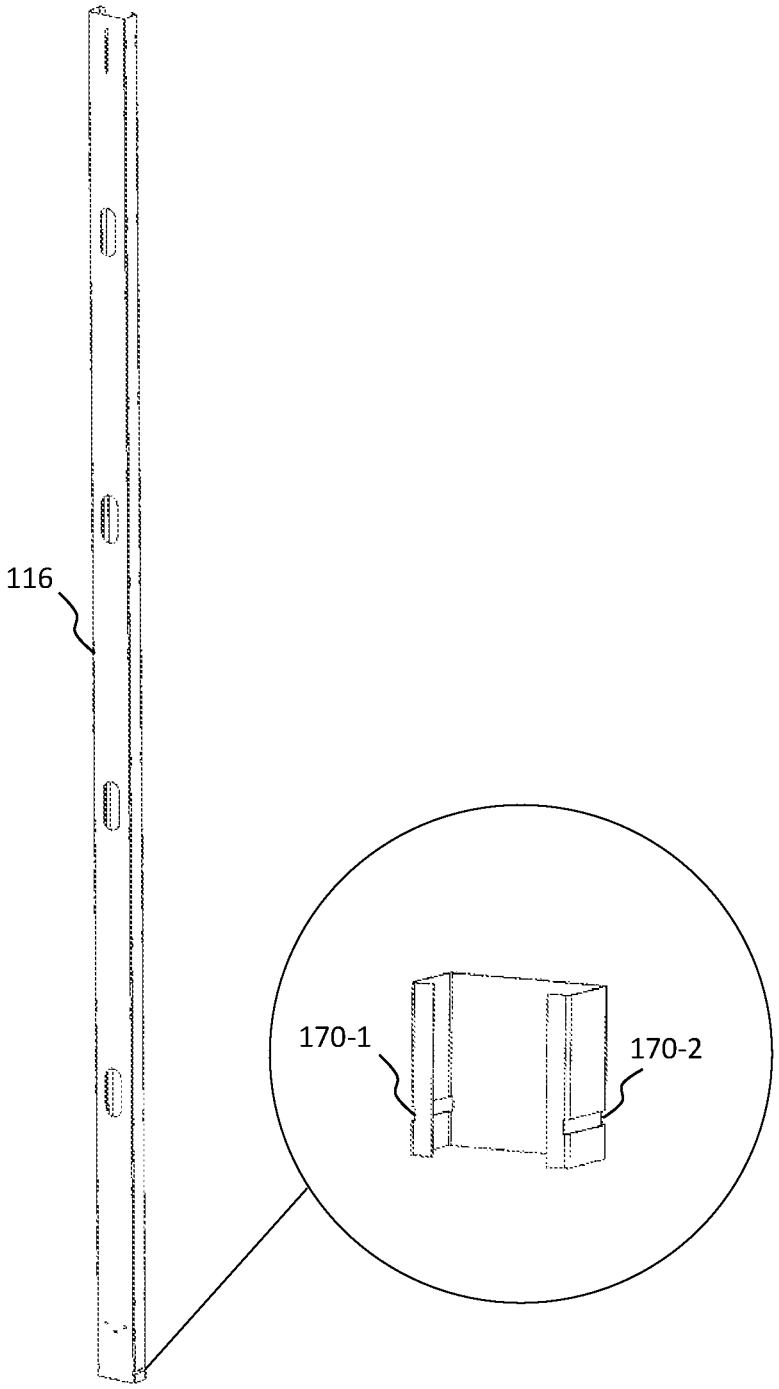
FIG. 9 illustrates a perspective view of a stud with a close-up view of a lower portion of the stud according to an example of the principles described herein.

Turning to FIG. 9, an example stud is shown. The stud includes an elongate member with slots for attachment of spacers. At the base on either side of each stud is a notch 170-1, -2. The notches 170-1, -2, like the notches 138-1, -2 of the lower leveler supports 126 (see FIG. 7), are to receive the offset bends 105-1, -2 (see FIG. 5) on either side to secure the studs to the base track 118.

In addition to leveling the bottom of the studs, the top of the studs may also be leveled. This allows for height nuances that can be fine-tuned at either end of the stud. For example, if a lower portion of a stud is level but the upper portion of the stud is not level, then the upper portion may be adjusted while leaving the lower portion as it is.

Turning to FIG. 10, a slip spacer assembly 144 is shown that is used to level the tops of the studs. The slip spacer assembly 144 includes a sleeve 146 having a cufflike structure defined by three perpendicular sidewalls that are dimensioned to slidably engage the stud. In another example, the sleeve 146 includes another cufflike structure with four perpendicular sidewalls that provide a hollow channel in which the stud 116 may be inserted and fully surround the stud 116 on all sides. Following the dimensions of the stud 116, two opposing sidewalls have a larger width than the other two opposing sidewalls, thus forming a rectangular channel through which the stud 116 is slidably inserted.

On two opposing sidewalls, there are opposing elongate slots 150 (one is not visible) in the illustration in which locking structure 152 is to attach the sleeve 146 to the stud 116 at a desired location and thus elevate the stud 116 to a desired height relative to the base track 118. As shown, the elongate slot 150 is located on the sidewall with a larger width. The slot length is parallel to the vertical axis of the stud 116. Locking structure 152 is used to secure the sleeve 146 to a desired location on the stud 116. The sleeve 146 may thus be raised above the stud 116 or kept below the stud 116 to provide a variable effective height for which the top track 120 may be secured. With a variable height, the height of the stud 116 may be maintained relative to other studs. The elongate slot 150 further comprises a slip connection that enables an accommodation for differential floor deflection between a ceiling on the top track 120 and a floor beneath the base track 118.

Figure 11:
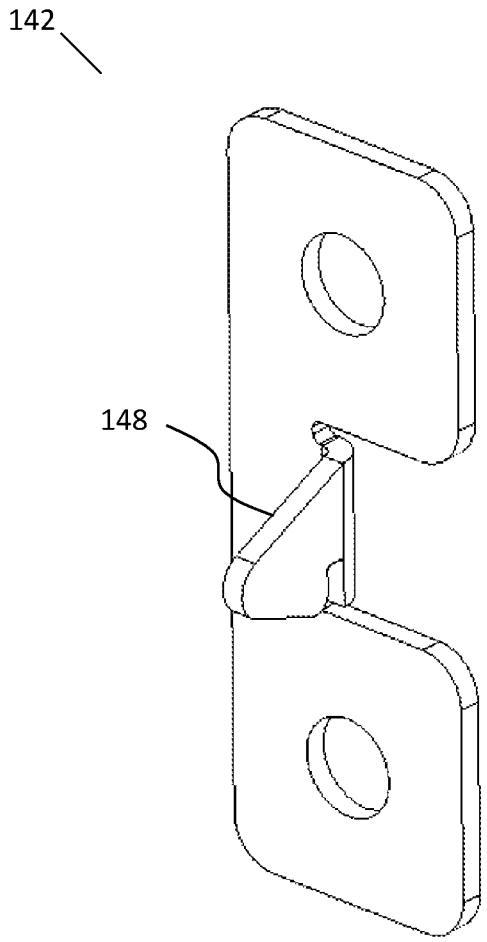
FIG. 11 illustrates a perspective view of a cladding retainer clip according to an example of the principles described herein.

FIG. 11 illustrates a cladding top hanger 142 for attaching cladding to a stud or a spacer. The cladding top hanger 142 shown includes a generally flat elongate member having a central locking structure 148 and attachment structure on an upper portion and a lower portion. As shown, the central locking structure 148 includes a perpendicular extension with a hook that attaches to edges of cladding. The upper and lower portions include holes as attachment structure for securing the cladding top hanger 142 to a stud or a spacer.

Figure 12:
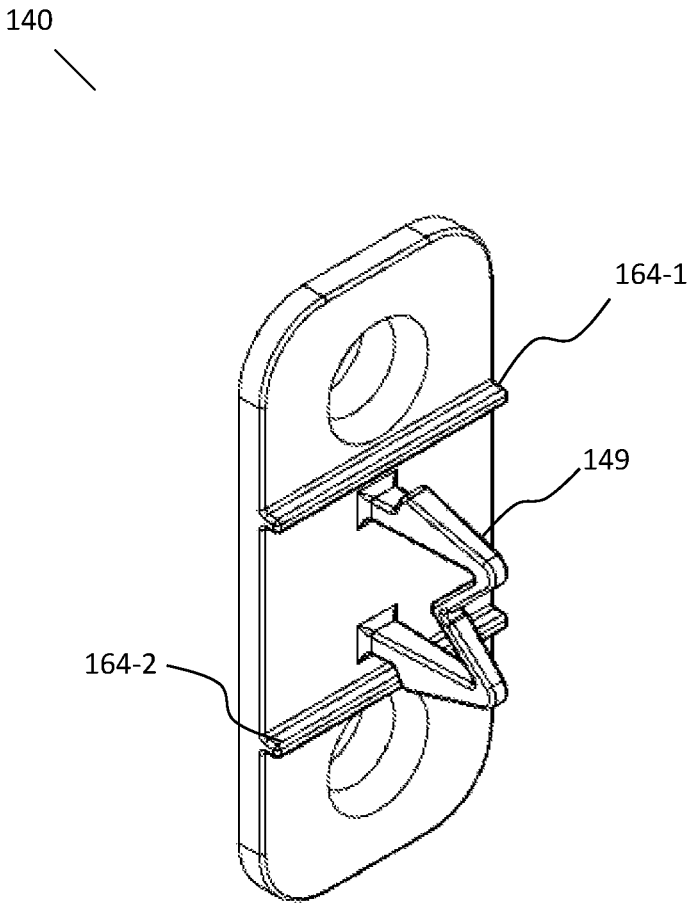
FIG. 12 illustrates a perspective view of a top hanger according to an example of the principles described herein.

FIG. 12 illustrates a cladding retainer clip 140 that includes a generally flat elongate member having a central resilient locking structure 149 and attachment structure on an upper portion and a lower portion. As shown, the central locking structure 149 includes an upper ridge 164-1 and a lower ridge 164-2. A clamp 149 between the upper 164-1 and lower ridge 164-2 includes opposite facing hooks that are attached by a resilient spring-like member. The opposite facing hooks are held in a non-neutral position. The hooks are squeezed together to be secured to edges of cladding. As they are released, they tend to move away from each other and back to the corresponding upper 164-1 and lower ridge 164-2. In this way, hooks clamp to edges of the cladding and secure the cladding in place. The upper and lower portions of the cladding retainer clip 140 include holes as attachment structure for securing the cladding top hanger 142 to a stud or a spacer.

Figure 13:
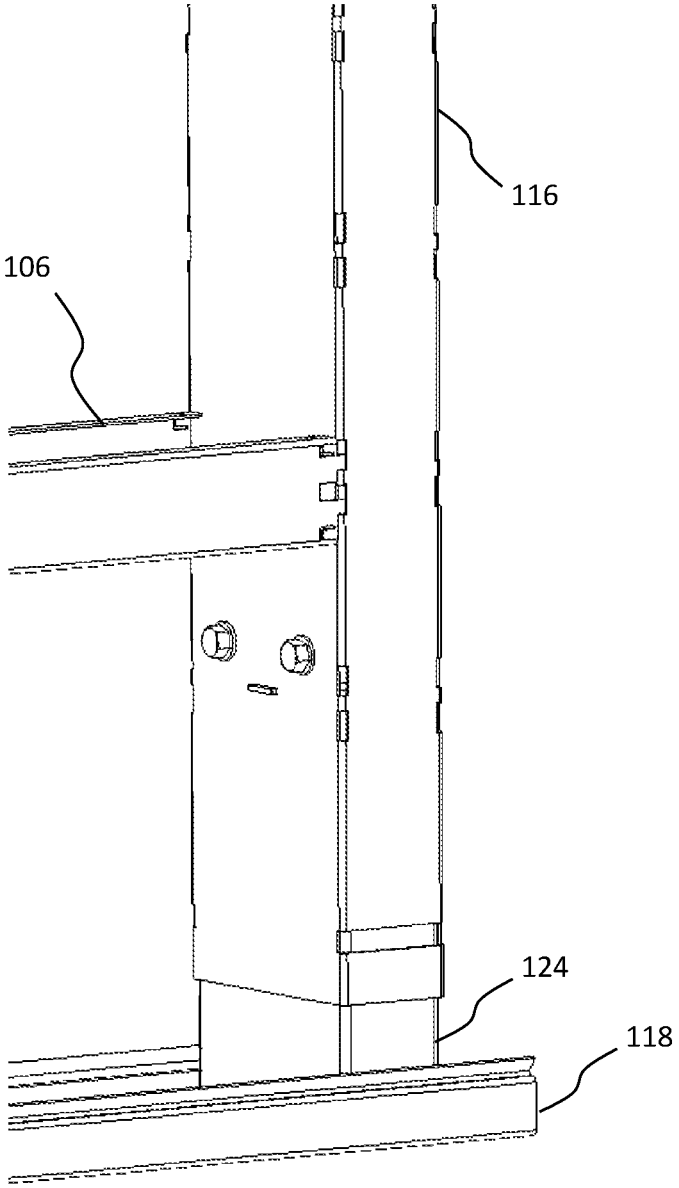
FIG. 13 illustrates a perspective view of a spacer attached to a stud and a leveling assembly according to an example of the principles described herein.

FIG. 13 illustrates an end portion of a spacer 106 attached to a stud 116. The stud 116 is elevated from the base track 118 with a leveling assembly 124.

Figure 14:
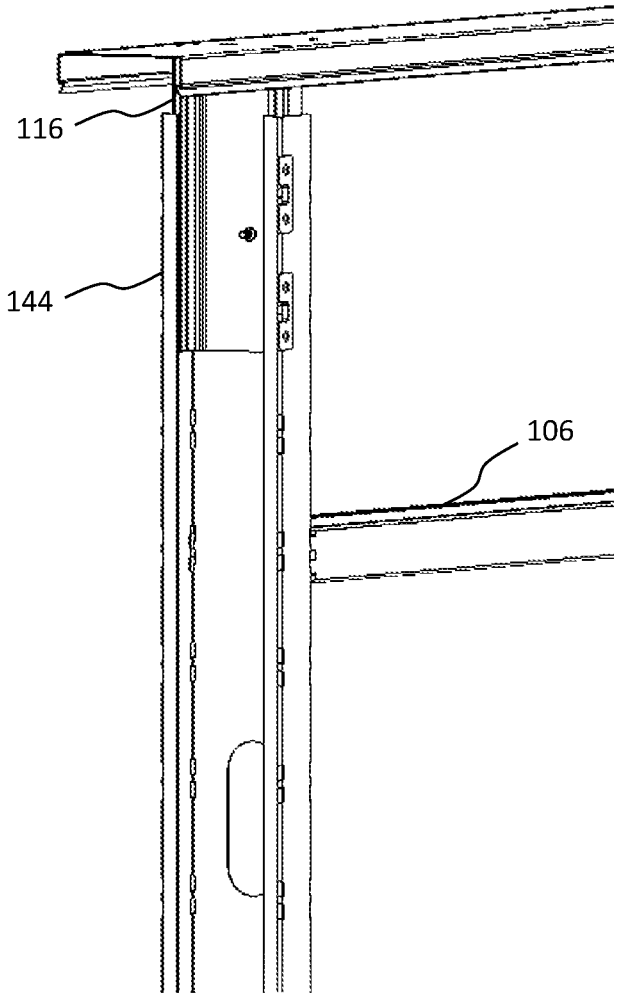
FIG. 14 illustrates a perspective view of a spacer attached to a stud and a slip spacer assembly according to an example of the principles described herein.

FIG. 14 also illustrates an end portion of a spacer 106 attached to a stud 116. The effective height of the stud 116 is elevated with a slip space assembly 144.

Figure 15:
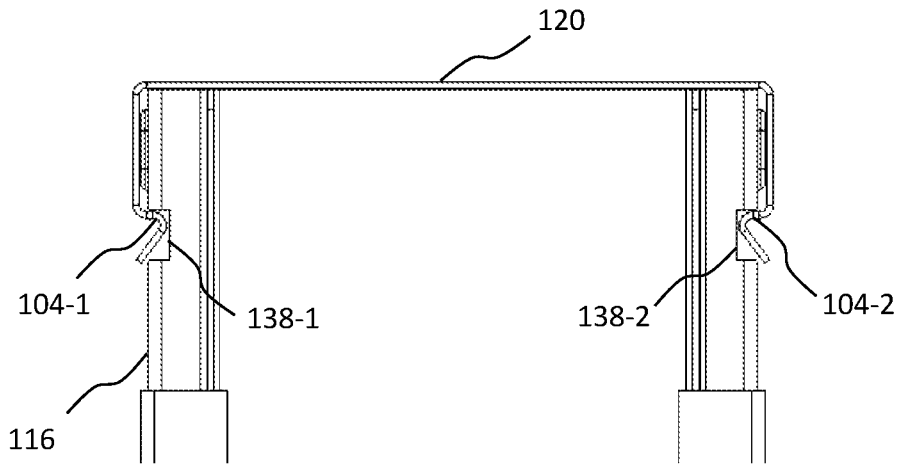
FIG. 15 illustrates a front cutout view of a leveling assembly according to an example of the principles described herein.

FIG. 15 illustrates a cutout view of a top track 120 on top of a stud 116. The offset bends 104-1, -2 of the top track 120 can be seen inserted within notches 138-1, -2 of the stud 116 to attach the top track 120 to the top of the stud 116.

Figure 16:
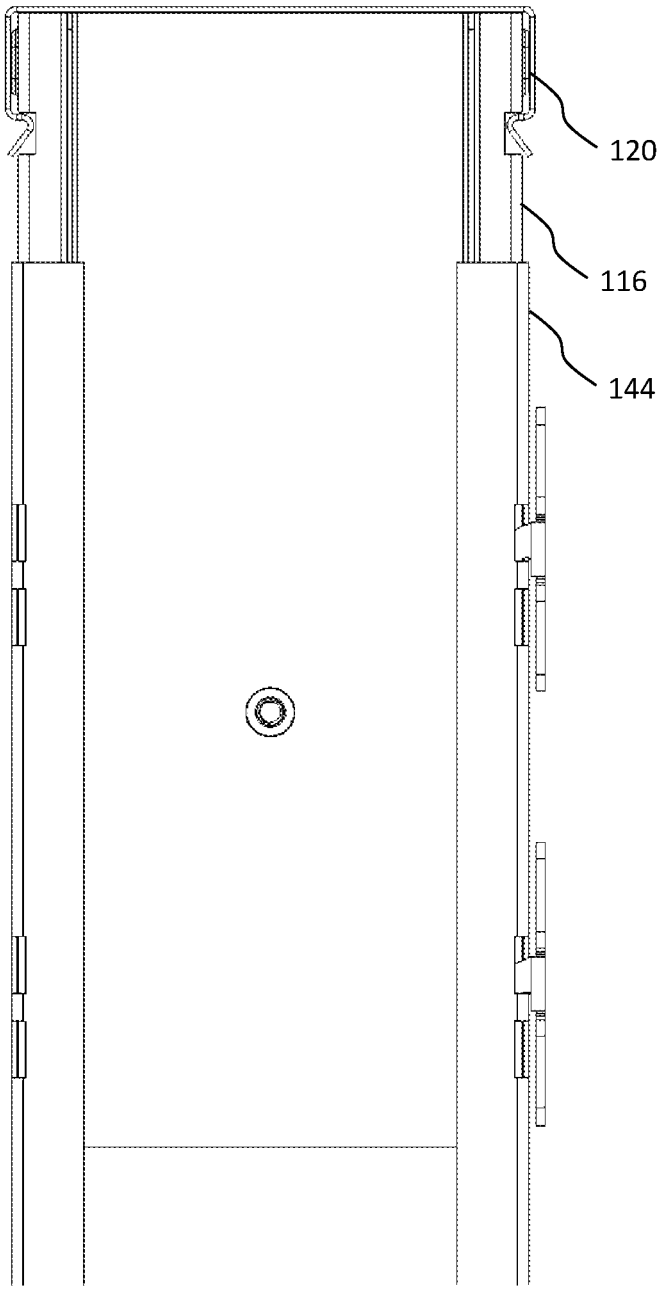
FIG. 16 illustrates a front cutout view of a slip spacer assembly and top track attached on top of a stud according to an example of the principles described herein.

FIG. 16 illustrates a cutout view of top track 120, stud 116, and slip space assembly 144. The slip connection of the slip space assembly 144 to the stud 116 can be seen. The effective height achieved by the slip space assembly 144 may be the same as or greater than or less than the effective height achieved by the leveling assembly 124 on the base track 118.

Figure 17:
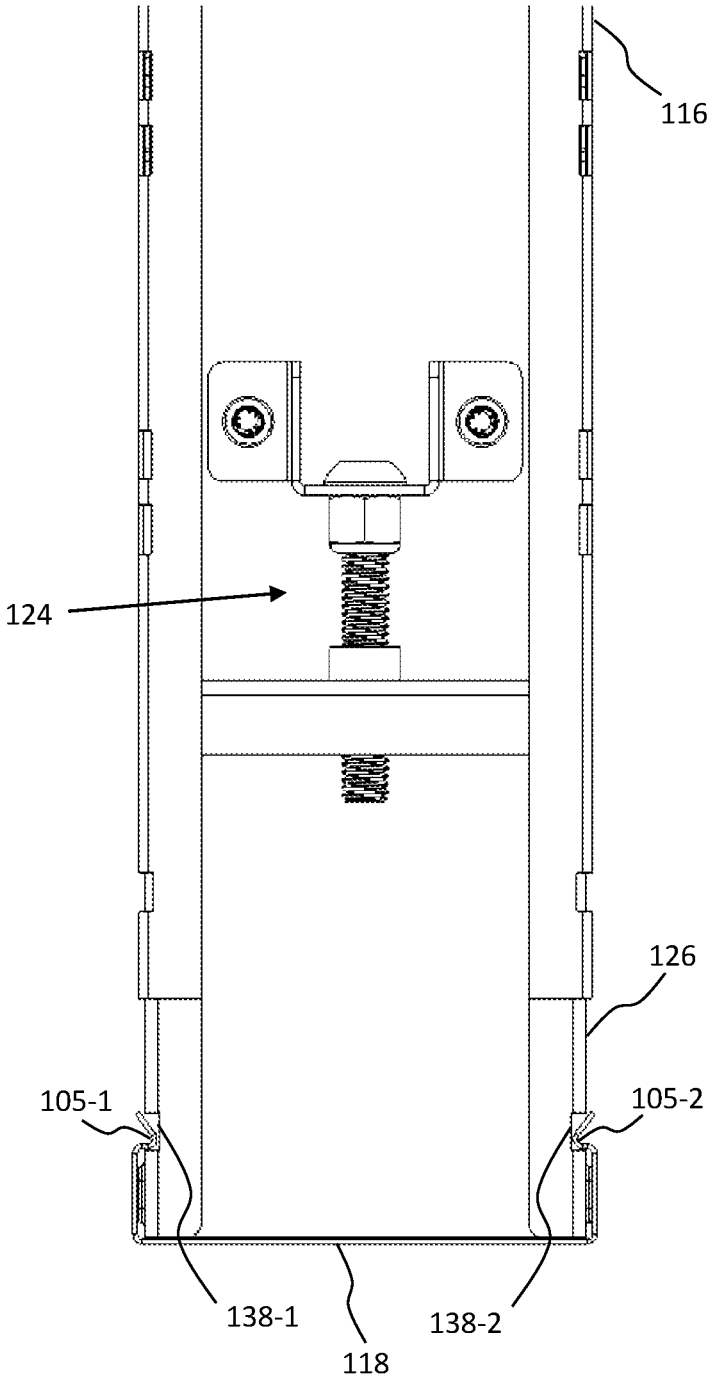
FIG. 17 illustrates a front cutout view of a leveling assembly on a base track, according to an example of the principles described herein.

FIG. 17 illustrates a cutout view of the base track 118, stud 116, and leveling assembly 124. The offset bends 105-1, -2 of the base track 118 can be seen inserted within respective notches 138-1, -2 of the lower leveler support 126. This connection attaches the base track 118 to the leveling assembly 124.

Figure 18:
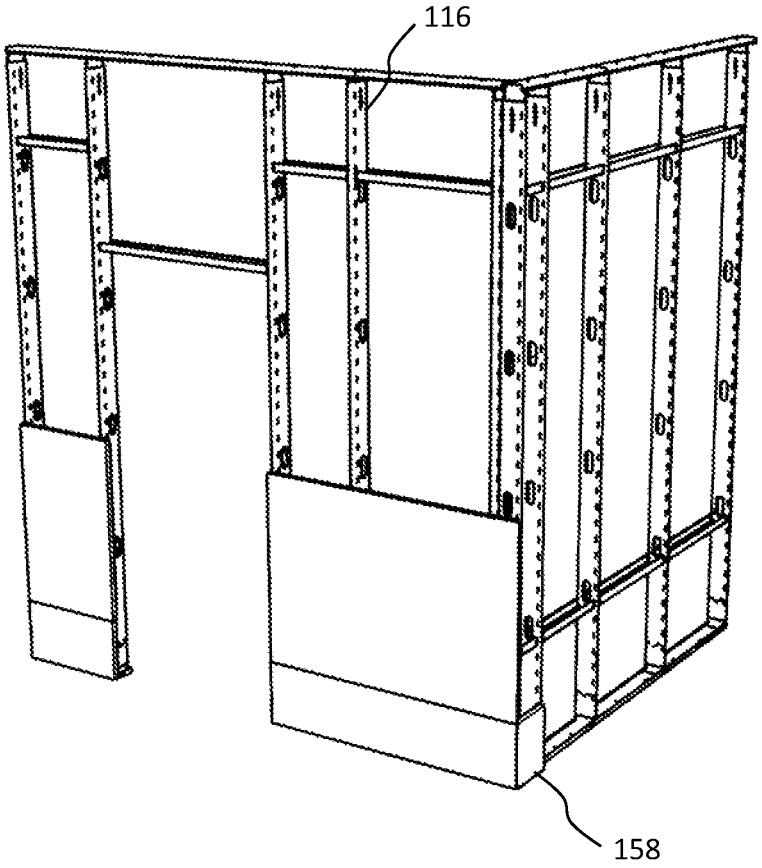
FIG. 18 illustrates cladding attached to a set of studs according to an example of the principles described herein.

FIG. 18 illustrates an example of cladding 158 attached to studs 116 that have the leveling assembly 124 (FIG. 17). Additional cladding may be attached to complete an enclosed structure.

Figure 19:
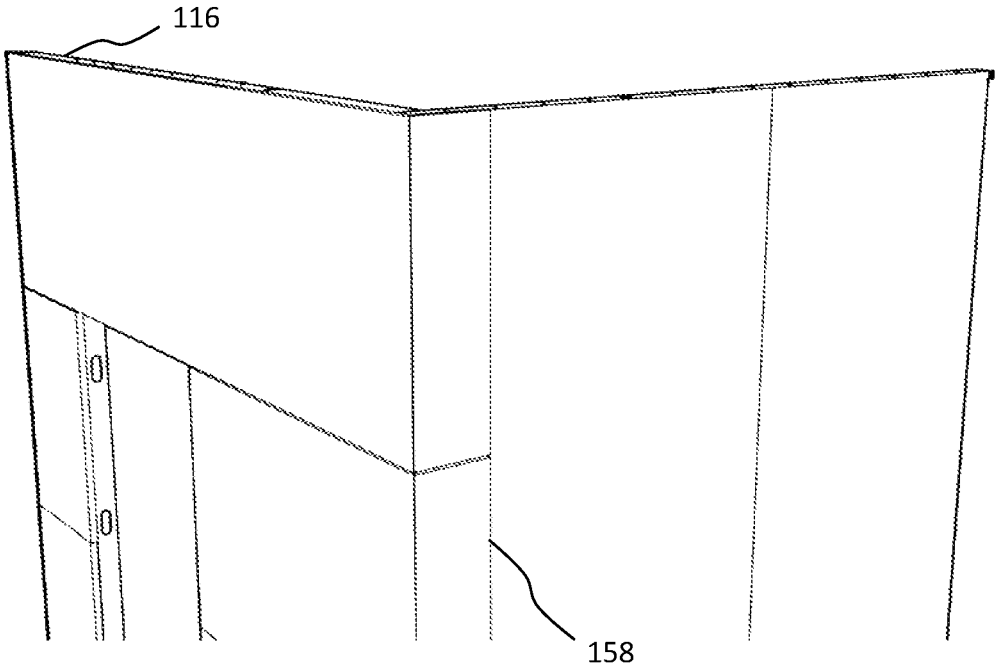
FIG. 19 illustrates drywall attached to a set of studs according to an example of the principles described herein.

FIG. 19 illustrates the cladding 158 reaching the top of the studs 116.

Figure 20:
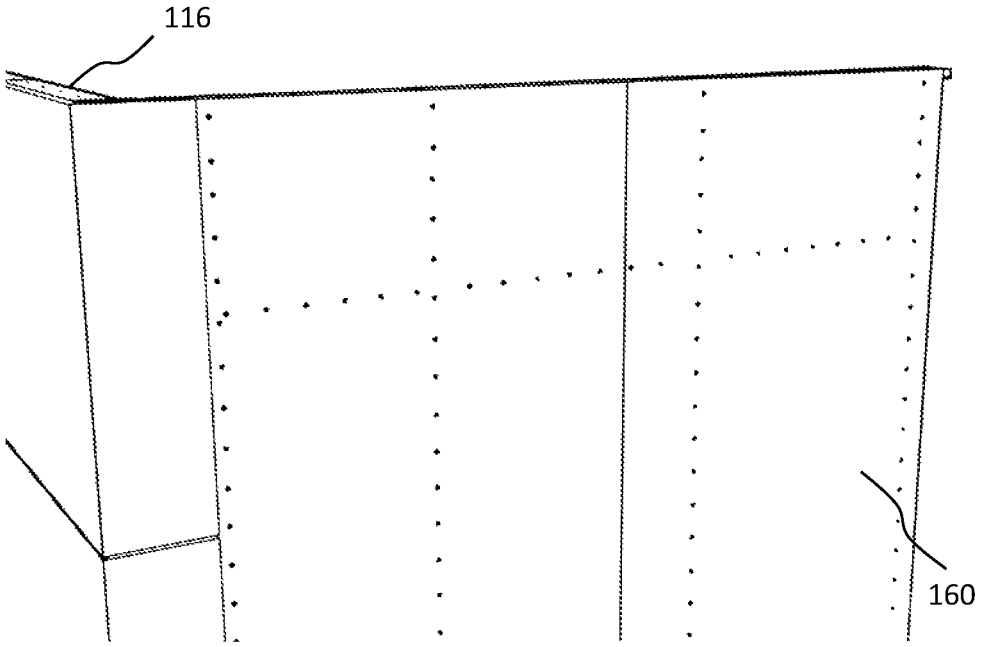
FIG. 20 illustrates drywall attached to a set of studs with drywall nails, according to an example of the principles described herein.

FIG. 20 illustrates drywall 160 attached to the studs 116 and spacers. The hybrid nature of the wall system may utilize both drywall 160 and cladding 158 which allows for modular walls and permanent walls to be supported.

Note that the hybrid wall system minimizes punching just to the edges of the studs to hang the cladding, so there is relatively the same amount of surface area for drywall screws as there would be for a non-hybrid wall system. The odds of getting holes on the sides of the studs is minimal which is useful for providing areas to hang cladding. This is beneficial for working with both cladding and drywall applications. Compared with a conventional steel stud being 1.5 inches wide, the screwing surface of an example hybrid stud is 1.35 inches, as measured by the slots. Elsewhere on the stud, the width is 1.47 inches. Thus, the hybrid stud provides an uninterrupted screwing surface.

Figure 21:
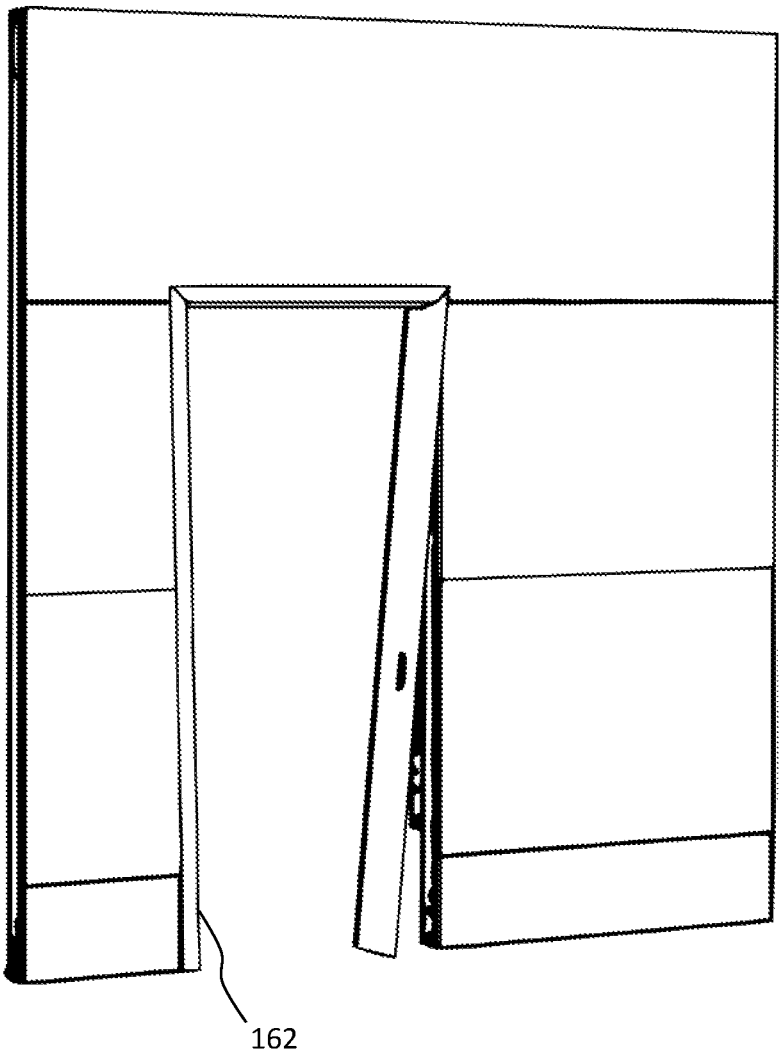
FIG. 21 illustrates a nearly completed doorway in a wall system according to an example of the principles described herein.

FIG. 21 illustrates a nearly completed doorway 162. In an example, the spacers have the same width as the stud. This enables the overall dimensions to be acceptable for the application of drywall. It also allows for standard fire-rated doors having a specific throat size to fit over walls.

The descriptions of the various examples of the present disclosure have been presented for purposes of illustration, but are not intended to be exhaustive or limited to the examples disclosed. Many modifications and variations will be apparent to those of ordinary skill in the art without departing from the scope and spirit of the described examples. The terminology used herein was chosen to best explain the principles of the examples, the practical application or technical improvement over technologies found in the marketplace, or to enable others of ordinary skill in the art to understand the examples disclosed herein.

What is claimed is:

1. A spacer for a hybrid wall system comprising:
spacers interspersed between studs;
a base track on which the studs are attached;
a top track that is attached on top of the studs; and
a leveling assembly on a portion of the base track that is used to raise and lower at least one of the studs; and
a portion of the base track remaining free of the leveling assembly;
the spacer comprising:
a flat elongate member;
a hook-like member on each end of the flat elongate member to secure ends of the flat elongate member between two studs;
a snap member on each end of the elongate member, the snap member defined by a slit or breakable material at an edge of the snap member such that the snap member is removable from the spacer to create a gap in attachment of the spacer to the studs such that the spacer can then be removed from between the studs.

2. The hybrid wall system of claim 1, the elongate member having two hook-like members spaced equally apart from opposing end corners of the elongate member, each hook-like member to be inserted into holes of studs.

3. A hybrid wall system, comprising:
studs;
spacers interspersed between the studs;
a base track on which the studs are attached;
a top track that is attached on top of the studs; and
a leveling assembly on a portion of the base track that is used to raise and lower at least one of the studs for purposes of attaching cladding to at least one of the studs; and
a portion of the base track remaining free of the leveling assembly for purposes of attaching drywall to remaining studs;
wherein each spacer comprises:
a flat elongate member;
a hook-like member on each end of the flat elongate member to secure ends of the flat elongate member between two studs;
a snap member on each end of the elongate member, the snap member defined by a slit or breakable material at an edge of the snap member such that the snap member is removable from the spacer to create a gap in attachment of the spacer to the studs such that the spacer can then be removed from between the studs.

4. The hybrid wall system of claim 3, each spacer further comprising a sidewall on either side of the elongate member, each sidewall being of equal width and extending along a length of the elongate member.

5. The hybrid wall system of claim 4, each sidewall further comprising corner portions that are part of the snap member to snap off or otherwise break away from the sidewalls to permit removal of the spacer after being attached to studs.

6. The hybrid wall system of claim 3, each spacer further comprising corner portions at each end of the elongate member that are part of the snap member to break away from the elongate member to permit removal of the spacer after being attached to studs.

7. The hybrid wall system of claim 3, the leveling assembly comprising:
a lower leveler support comprising:
an elongate member;
sidewalls having an attachment at one end to attach to the base track.

8. The hybrid wall system of claim 7, the leveling assembly further comprising:
an upper leveler support comprising:
a flat top;
perpendicular sidewalls that extend from the flat top; and
side arms on either side of the flat top and perpendicular sidewalls, the side arms to be affixed to a stud, the flat top to be affixed to the lower leveler support by a screw such that adjustment of the screw raised and lowers the stud affixed to the upper leveler support.

9. The hybrid wall system of claim 7, each of the side arms further comprising:
an outer facing protrusion that is to space the sidewalls of the leveling assembly between sidewalls of the base track, and
a notch to lock the stud to the base track.

10. The hybrid wall system of claim 7, the sidewalls of the lower leveler support having a cross-sectional area to nest within sidewalls of the stud and thus provide strength to the leveling assembly as a whole.

11. The hybrid wall system of claim 3, further comprising at least one cladding retainer clip to hang cladding to a stud.

12. The hybrid wall system of claim 3, further comprising at least one top hanger to hang cladding to a stud.

13. The hybrid wall system of claim 3, the base track further comprising a flat elongate base track having sidewalls that extend perpendicularly from side edges of the base track, each sidewall having an offset bend at an end portion such that the end portion juts toward an inner space between the sidewalls, with outer edges extending at an angle relative to the sidewalls, the offset bend to tighten around sides of the leveling support to removably lock the lower level assembly to the base track.

14. The hybrid wall system of claim 3, wherein the leveling assembly comprises comprising:
a slip spacer assembly that is used to level the tops of the studs.

15. The hybrid wall system of claim 14, the top track and base track being the same.

16. The hybrid wall system of claim 14, the studs each having a notch on each side to lock the stud to the base track.

17. A hybrid wall system, comprising:
studs;
spacers interspersed between the studs;
a base track on which the studs are attached;
a top track that is attached on top of the studs; and
a leveling assembly on a portion of the base track that is used to raise and lower at least one of the studs; and
a portion of the base track remaining free of the leveling assembly;
wherein the leveling assembly comprises comprising a slip spacer assembly that is used to level the tops of the studs,
the slip spacer assembly comprising:
a sleeve having three perpendicular sidewalls that are dimensioned to slidably engage the stud; and locking structure to secure the sleeve at a desired location to the stud to extend the stud above the sleeve at the desired location to thereby level a height of the stud relative to other studs.

18. The hybrid wall system of claim 17, the locking structure comprising:

an elongate slot along a length of one of the sidewalls, and a screw to attach the sleeve through the elongate slot to the stud at the desired location.

19. The hybrid wall system of claim 18, the sleeve further comprising:

four perpendicular sidewalls that provide a hollow channel in which the stud may be inserted and fully surrounding on all sides, and at least two elongate slots on two opposing sidewalls in which locking structure is to attach the sleeve to the stud at a desired location and thus elevate an effective height of the stud to a desired height relative to the base track.

20. The hybrid wall system of claim 18, the elongate slots further comprising a slip connection that enables an accommodation for differential floor deflection between a ceiling on the top track and a floor beneath the base track.

* * * * *